United States Patent [19]

Undin et al.

[11] 4,353,240

[45] Oct. 12, 1982

[54] CRIMPING TOOL

[75] Inventors: Hans Undin, Akersberga; Hans Wiener, Täby, both of Sweden

[73] Assignee: Toolema AB, Stockholm, Sweden

[21] Appl. No.: 112,192

[22] Filed: Jan. 15, 1980

[51] Int. Cl.[3] ..... B21D 37/10

[52] U.S. Cl. ..... 72/410; 81/417; 81/418; 81/421; 81/426

[58] Field of Search ..... 72/410, 409, 416; 81/313, 421, 422, 423, 425 R, 425 A, 426, 427, 417, 418

[56] References Cited

U.S. PATENT DOCUMENTS

| | | | |
|---|---|---|---|
| 1,619,084 | 3/1927 | Miller | 72/409 |
| 1,666,801 | 4/1928 | Varney | 72/409 |
| 2,763,171 | 9/1956 | Modrey | 72/410 |
| 3,090,418 | 5/1963 | Marak | 72/415 |
| 3,487,524 | 1/1970 | Filia | 81/421 |
| 4,048,877 | 9/1977 | Undin | 81/313 |
| 4,078,303 | 3/1978 | Wiener | 81/9.51 |
| 4,199,972 | 4/1980 | Wiener | 72/409 |

FOREIGN PATENT DOCUMENTS

| | | | |
|---|---|---|---|
| 165024 | 10/1958 | Sweden | 72/410 |
| 80555 | 3/1919 | Switzerland | 72/409 |
| 1141179 | 1/1969 | United Kingdom . | |

*Primary Examiner*—Gene Crosby

*Attorney, Agent, or Firm*—Toren, McGeady and Stanger

[57] ABSTRACT

A crimping tool includes a pair of arm members and a driving mechanism such as a pair of handles for moving the arm members. An elongated working jaw is mounted on each of the arm members, one of the working jaws having a female die and the other working jaw having a male die arranged thereon. The female die has a notch, and the male die has a base part and an elongated leading face spaced from the base part. A locking mechanism prevents the driving mechanism from returning to an open position before the driving mechanism is brought to a fully closed position. A resilient elastomeric block is provided in the tool to enable the driving mechanism to be brought to the closed position when an article to be crimped is located between the working jaws.

13 Claims, 7 Drawing Figures

FIG. 1
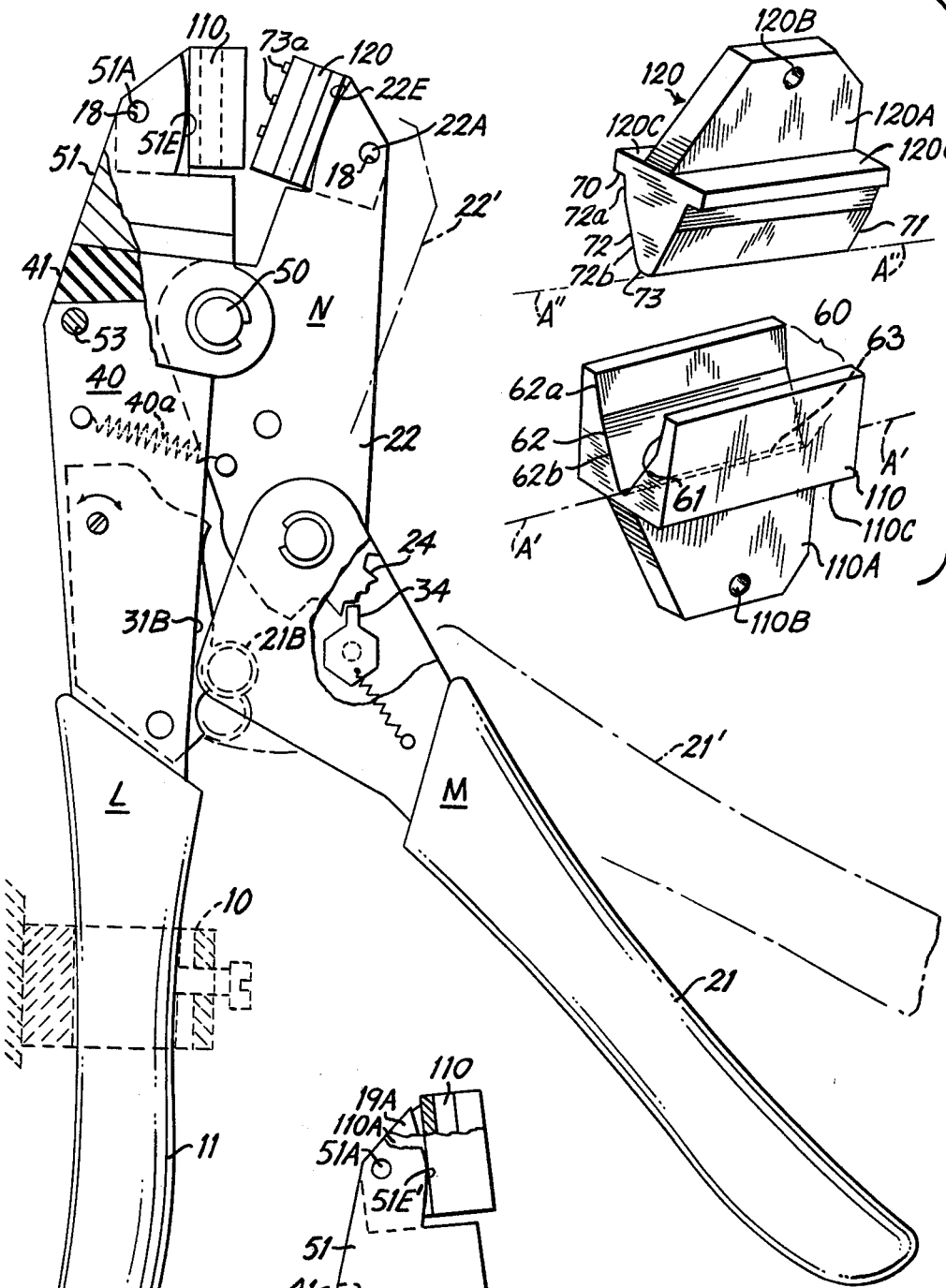
FIG. 3
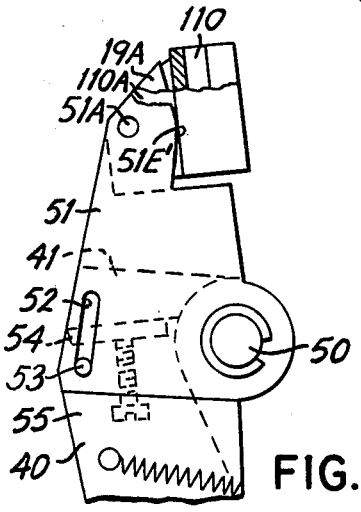
FIG. 2

CRIMPING TOOL

BACKGROUND OF THE INVENTION

The present invention relates to a crimping appliance or tool for fastening ferrules, such as those associated with terminal connectors, and which are within a given size range, onto the ends of rod-like articles such as electrical conductors by way of a pair of cooperating dies forming a part of the tool.

The tool includes a pair of cooperating, elongated working jaws, and a pair of arm members on which the jaws are mounted, each jaw carrying one of the cooperating dies. The arm members are movable relative to each other between an open configuration or position at which the working jaws are separated from each other, and a closed configuration or position at which the working jaws close against each other or about an article placed between them.

Each arm member is situated at one end of a force transmitting path, the other end of which is at a point on the tool where an external force is to be applied (hereinafter "force application point"). For one of the arm members, the externally applied force operates as a driving force to provide closing movement to the arm member, the force application point being located on a driving mechanism associated with the arm member. For the other arm member, the externally applied force can also operate as a driving force to provide closing movement, or it can originate from a stationary clamp on a part joined to the arm member, the clamp serving to support the tool while the first mentioned arm member is operated.

A resilient member of predetermined hardness and strength is interposed in at least one of the force transmitting paths to compensate for the presence of an article between the working jaws by allowing the driving mechanism to be fully actuated by an externally applied force, even though the jaws cannot be fully closed. A pawl and ratchet locking mechanism prevents the driving mechanism from returning to its open configuration after relative closing movement of the arm member is initiated and before the driving mechanism is brought to its closed configuration.

An appliance or tool in the same category as the present invention is disclosed in British patent application Ser. No. 52366/77 or U.S. patent application Ser. No. 852,724 (now U.S. Pat. No. 4,199,972) of one of the co-inventors. In that tool, arm members and associated working jaws are pivotally movable relative to each other so that the tool operates in a tong-like manner. In the tool of the present invention, the arm members and the working jaws may also be arranged to move relative to each other over a straight or translatory path of movement to operate in a vise-like manner such as disclosed in, for example, British Pat. No. 1,141,179.

The term "working jaws", as used herein, refers to the particular parts which are adapted to perform the intended operation of the tool, i.e., the parts which are in the shape of, or provided with, the two cooperating crimping dies. The term "arm member", as used herein, refers to each part which is connected between a working jaw and a driving mechanism or handle. The term "force transmitting path", as used herein, refers to a path made up of parts of the tool which are rigidly or operationally interconnected and which extend between a working jaw at one end and a corresponding force application point at the other end, an externally applied force being transmitted through this path from the force application point to the working jaw.

It will be readily understood that it is usually desirable for a given tool to have the capability of performing work on articles whose sizes vary within as large a range as possible, thereby obviating the need for a number of different sized tools, or the need for interchangeable sets of working jaws. For example, crimping tools are known which have working jaws provided with three pairs of crimping dies of different dimensions, each pair consisting of a male and a female die. Such a crimping tool is shown, for example, in the British Pat. No. 1,141,179, wherein the female as well as the male die of each pair of crimping dies has a concave face for engaging a ferrule. Such a tool does not offer the possibility of satisfactorily treating ferrules having diameters lying between the discrete values which correspond to the die pairs provided.

A tool which can work on ferrules having diameters within a given size range is disclosed in British Pat. No. 1,523,160 or U.S. Pat. No. 4,078,303 of one of the co-inventors. The working jaws of the tool each have a number of projecting transverse webs positioned one behind the other in the axial direction of the article to be treated, so that gaps are provided between adjacent webs. The construction of the working jaws is quite elaborate and, therefore, expensive in that each projecting web has one rather narrow engagement face for grasping the article to be worked on, and about half of the engagement faces on each jaw lie in a first hypothetical plane which is inclined to a plane of symmetry of the respective jaw from a first side of the jaw, and the remainder of the engagement faces on each jaw are contained in a second hypothetical plane which is inclined to the plane of symmetry of the jaw from a second, opposite side of the jaw. During the course of closing movement of the jaws relative to each other, the projecting webs on one jaw penetrate gradually into the gaps between the projecting webs of the other jaw, the engagement faces of all the projecting webs defining a quadrilateral channel or opening which continuously decreases as the jaws approach one another. Both jaws are similar in form so that neither of them can be described as a male or a female die. Production of these jaws is however quite expensive in view of the number of projecting webs with the gaps between them and the engagement faces each of which lie in one of four different planes.

An object of the present invention is to provide a crimping tool having working jaws which can be produced at relatively little expense.

In accordance with the present invention, a crimping tool includes a pair of working jaws with a male die on one of the working jaws and a female die on the other. The female die is defined by an elongated notch, the sides of which taper toward each other from the longitudinal opening of the notch to a closed end wall of the notch, the notch having a depth in its transverse cross-section which is substantially equal to the transverse width of its longitudinal end opening.

The tool also includes an elongated male die on the other working jaw, the height of the male die in transverse cross-section being substantially equal to the depth of the female die. The male die is shaped and dimensioned so as to be fully contained within the notch of the female die when the working jaws are closed against each other.

A driving mechanism is provided for moving the arm members relative to each other between an open configuration and a closed configuration, and a locking mechanism associated with the driving mechanism operates to prevent the arm members from moving toward their open configuration unitl the driving mechanism is fully actuated to a closed configuration corresponding to closure of the working jaws without an article placed between them. A resilient member associated with at least one of the jaws operates to compensate for less than full closure of the jaws when an article is placed between them so that the driving mechanism can be fully actuated thereby allowing the arm members to return to their open configuration.

The tool of the present invention can thus accommodate ferrules having any diameter up to the depth of the notch in the female die. The ferrules will be pressed into the notch of the female die by the male die in response to a compressive force which increases with the diameter of the ferrule. It will be understood that the compressive force increases according to the size of the ferrule because further compression of the resilient member is required when a larger article is inserted between the working jaws than when a smaller article is so placed. Since the fully actuated configuration of the driving mechanism, at which it is released by the locking mechanism, is always the same, additional force must be applied to the tool and, hence, to a larger ferrule to further compress the resilient member while bringing the driving mechanism to its fully actuated or closed configuration. The final distance between the closed end wall of the notch in the female die and the leading face of the male die will be the greater, the greater will be the final dimension of a ferrule crimped by the dies in the direction of the closing movement of the working jaws. As used herein, the terms "empty working jaws" or "working jaws in an unloaded state" refer to the condition when no work pieces, e.g. a ferrule, is inserted between the working jaws.

It has been found that ferrules of widely varying diameters can be best accommodated when the notch in the female die in transverse cross-section is in the shape of a parabola, or at least a piecewise or sectional linear approximation of a parabola, rather than simply being in the form of a "V". A piecewise linear approximation is realized when each side of the notch in transverse cross-section is formed by at least two straight line sections which form an obtuse angle and are substantially tangent to a given parabola. The number of straight sections chosen depends on how close an approximation to the parabola is desired and which can be practically achieved. A straight line section extending between the sides of the notch in transverse cross-section is tangent to the apex of the parabola. This line section corresponds to the elongated closed end wall of the notch which extends longitudinally in a plane between the notch side walls.

The male die can either be entirely complementarily shaped with respect to the notch in the female die, or it can have any other shape which does not extend beyond the bounds of such a complementary shape, as will be explained in further detail below.

In vise-like tools, a pair of jaws approach each other while the jaw faces remain in parallel relationship to each other. However, in tong-like tools having arm members which move pivotally relative to each other, the arm members approach each other in an inclined relationship. Therefore, with tong-like tools, jaws having elongated working portions must be mounted either with the elongated portions at right angles to the plane of pivotal movement of the arm members, or in the plane of the pivotal movement with at least one of the working jaws being pivotally mounted to a corresponding arm member for rotation about an axis perpendicular to the plane of the pivotal movement. By such mounting, parallel alignment of the two working jaws can be realized when the jaws contact each other or an article inserted between them.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

BRIEF DESCRIPTION OF THE DRAWING

In the drawing:

FIG. 1 is a front elevational, partially broken view of a crimping tool according to the present invention;

FIG. 2 is a detailed, partially broken view of a modified version of an arm member shown in the tool of FIG. 1;

FIG. 3 is an enlarged perspective view of a pair of elongated working jaws including male and female dies shown in the tool of FIG. 1;

DETAILED DESCRIPTION OF THE INVENTION

Figure 4:
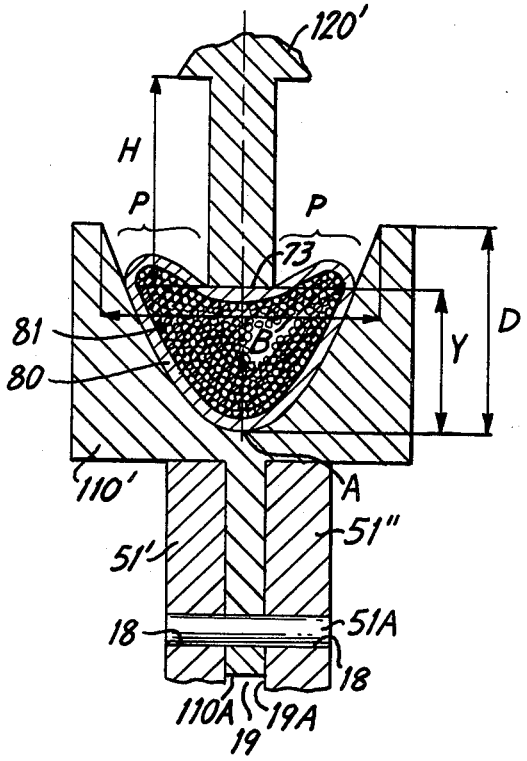
FIG. 4 is an enlarged cross-sectional view taken transversely of the longitudinal axis of a modified version of the female die of FIG. 3, the female die having a ferrule crimped therein by a modified version of the male die.

FIG. 1 shows a crimping tool according to the present invention, the tool including a handle 11 which is maintained stationary by being held by the user or e.g. by means of a clamp 10 as represented in the drawing in dashed lines, and another handle 21 which is mounted for pivotal movement relative to the handle 11. The handle 21 forms part of a driving mechanism for the tool. A cam and follower mechanism 21B, 31B guides the movement of the handle 21, the cam and follower mechanism being more fully described in U.S. Pat. No. 4,048,877 or British Pat. No. 1,500,101 of one of the co-inventors and being outside the scope of the present invention.

Handle 21 is pivotally connected to an arm member 22 so that movement of handle 21 relative to the handle 11 is transferred to the arm member 22. Arm member 22 is mounted for pivotal movement relative to tool body part 40 by way of a pivot pin 50. Tool body part 40 is rigidly joined to the stationary handle 11.

Another arm member 51 is mounted for pivotal movement about the axis of the pivot pin 50, and a working jaw 110 is mounted on the arm member 51. Likewise, another working jaw 120 which cooperates with the working jaw 110 is mounted on the arm member 22.

A resilient block 41 of elastomeric material such as, for example, natural or synthetic rubber, or polyurethane, extends between the arm member 51 and the tool body part 40. As shown in FIG. 2, arm member 51 has an elongated slot 52 therein, and a pin 53 extends from the tool body part 40 through the slot 52 to limit the extent of pivotal movement of the arm member 51 relative to the tool body part 40 or the handle 11. Slot 52 also defines the mutual relationship of the arm member 51 to the tool body part 40 when the tool is not operated, i.e., when no operating stress is transmitted to the arm member 51. The block 41 can be pre-stressed, if desired, by appropriate selection of the dimensions of the block 41 relative to the size of the opening between the tool body part 40 and the arm member 51 into which the block 41 is fitted.

For adjustable pre-stressing, a movable plate 54 (FIG. 2) may be placed between the tool body part 40 and the block 41, and an adjustment screw 55 can extend through a stationary nut member (not shown), arranged in a hollow interior space of the tool body part 40, to engage the plate 54 and move it in an upward direction as viewed in FIG. 2. Accordingly, pre-stress can be applied to or increased in the block 41, the pin 53 abutting one end of the slot 52 to prevent the plate 54 from pivoting the arm member 51 in the direction toward the arm member 22.

Referring again to FIG. 1, the movable handle 21 and its associated arm member 22 are shown in phantom lines which correspond to their fully open configurations 21', 22' whereat the working jaws 110,120 are fully opened.

A pawl and ratchet mechanism, including a ratchet 24 formed on the arm member 22 and a spring loaded pawl 34 mounted on the handle 21, operates to prevent opening movement of the working jaws before the handle 21 has been moved to a fully closed configuration with respect to the handle 11. Thus, handle 21 cannot be returned to the fully open configuration 21' until after it is moved toward the handle 11 to a relative position corresponding to the full closure of the working jaws desired to be obtained. A pawl and ratchet mechanism of this kind is more fully described in said U.S. Pat. No. 4,048,877 or British Pat. No. 1,500,101 of one of the co-inventors.

It will be understood that when an external force is applied to the handle 21, a force transmitting path is established through the handle 21 and the arm member 22 to the working jaw 120, and a reaction force is applied to the handle 11 e.g. by the clamp 10. This reaction force follows another force transmitting path through the handle 11, the tool body part 40, the resilient block 41 and the arm member 51 to the other working jaw 110. It will be understood that the resilient block 41 may be interposed at other locations in the force transmitting paths such as, for example, at L in the handle 11, at M in the handle 21 or at N in the arm member 22.

Working jaws 110,120 are shown in an enlarged scale and in further detail in FIG. 3. Working jaw 110 has a female die formed thereon, the female die being defined by an elongated notch having opposed side walls 61,62 which extend from an elongated open end 60 which faces the working jaw 120, and taper toward each other until they reach a closed end wall 63 which is formed by a relatively narrow elongated planar surface on the jaw 110. Each of the side walls 61,62 is formed by two planar surface sections such as *62a,62b* which form an obtuse angle and are substantially tangent to an inscribed parabola having its apex tangent to the elongated planar surface defining the closed end wall 63 of the female die. Line A'—A' represents the longitudinal axis of the female die.

The working jaw 120 has a male die formed thereon which is complementarily shaped relative to the female die, the male die having side walls 71,72 which extend from a base part 70 and taper toward each other to a leading face 73 which is defined by a relatively narrow elongated planar surface. The side walls 71,72 are each formed by two planar surface sections such as *72a,72b* which bear the same angular relationship to each other at the planar surface sections *62a,62b* of the female die.

A number of spaced apart protrusions such as buttons *73a* (FIG. 1) may be provided on either one of the narrow die surfaces 63,73 for making impressions or indentations into an article to be crimped.

The working jaws 110,120 have corresponding lugs 110A, 120A, the lugs having holes 110B, 120B for receiving mounting pivot pins 51A,22A (FIG. 1), respectively. Lug 120A extends over the base part 70 and in the longitudinal direction of the working jaw 120. The lug thickness in the direction transverse of the jaw 120 is less than the breadth of the jaw 120 in the transverse direction. On the side of the base part 70 which faces lug 120A, surface sections 120C extend outwardly from both sides of the lug 120A.

Recesses are formed in the arm members 22,51 such as recess 19 in arm member 51, as shown in FIG. 4. These recesses in the arm members accommodate the lugs 110A, 120A of the working jaws, the recesses extending centrally of the cross-sectional profile of the arm members, as viewed in FIG. 4. Side wall surfaces such as 19A (FIGS. 2 and 4) extend over both sides of the lugs and guide their movement. The side walls of the recesses in the arm members such as 51', 52'' (FIG. 4) have holes 18 therein which are aligned with the holes 110B, 120B to receive the pivot pins 51A, 22A, respectively. It will be understood, however, that a pivotal connection between each of the working jaws and a corresponding arm member can be provided in some other known manner. The two working jaws 110,120 and the dies thereon will properly align themselves as the arm members 22,51 are closed.

In order to relieve pivot pins 22A, 51A from excessive shear stress when the working jaws are closed to crimp an article, the side walls such as 51', 51'' defining the lug recesses in the arm members 22,51 have curved surfaces 22E, 51E (FIG. 1) on their outer edges for contacting the working jaws. Each of the surfaces 22E, 51E has a radius of curvature centered at the corresponding one of pivot pins 22A,51A. The lug openings 110B, 120B for the pivot pins 22A, 51A are located away from surface sections 110C, 120C of the working jaws 110,120, respectively, by distances corresponding to the radii of curvature of the surfaces 22E, 51E. Thus, the surface sections 110C, 120C of the working jaws bear against the curved surfaces 51E, 22E, respectively, as the working jaws pivot relative to their corresponding arm members.

According to a modification shown in FIG. 2, the outer edge surfaces of the side walls forming the recesses in the arm members 22, 51 may each be angularly shaped such as the surface 51E'. One straight section of the surface 51E' provides support over its entire length to the working jaw 110 when the two arm members 22, 51 are fully closed.

The working jaws 110,120 can also be rigidly mounted to the arm members so that their longitudinal axes are each parallel to the axis of rotation of the arm members 22,51 relative to each other. Pivotal mounting of the working jaws 110,120 is likewise unnecessary when the arm members 22,51 close upon each other in a vise-like manner with only translatory relative movement, as will be explained in connection with FIG. 6.

FIG. 4 shows a working jaw 110' including an elongated female die having a transverse cross-section which conforms to a parabola having its apex at point A. The female die cooperates with a male die on another jaw 120', the male die being in the form of a rib having a leading face 73 defined by a relatively narrow elongated planar surface. The depth D of the notch in the female die is of the same order of magnitude as the transverse breadth B of the end opening of the notch. The depth D is also substantially equal to the height H of the male die, as shown in FIG. 4.

A terminal connector ferrule 80, which has been placed over one end of a stranded electrical conductor 81, is inserted in the female die and, as shown in FIG. 4, is crimped onto the conductor 81 by moving the handle 21 (FIG. 1) away from its open configuration 21', thereby urging the male die against the ferrule 80 and deforming it into a heart shaped cross-sectional profile as shown in FIG. 4.

After initial contact between the male die and the ferrule 80, the resilient block 41 is compressed with increasing force. However, before the handle 21 can be returned to its open configuration 21' (e.g., by action of a spring 40*a* in FIG. 1), the handle 21 must be actuated through a full driving stroke before the pawl and ratchet mechanism 24, 34 will allow it to return to the open configuration 21'. Therefore, the force applied to the ferrule 80 is essentially generated by the resilient block 41, particularly in the final phase of the crimping operation. As shown in FIG. 4, open regions P above the crimped ferrule will always extend along both sides of the male die, provided the distance Y between the leading face 73 of the male die and the closed end wall of the female die is greater than zero. The same result will also be obtained when the male die is complementarily shaped with respect to the female die as, for example, in FIG. 3. It will therefore be appreciated that since the transverse cross-section of the male die is bounded within limits defined by the female die whose side walls taper toward each other to its closed end wall, the male die will always be of narrower profile or "convex" relative to the female die so as to provide the two open regions P over a crimped article when the dimension Y is other than zero.

The parabolic shape of the female die in transverse cross-section, or the approximation of a parabolic shape, has been found to be optimal for crimping articles having diameters of varying size, considering that during a final crimping phase, the resilient block 41 will provide a lower crimping force on a small article than on a larger one, and that the resistance of the article to crimping is dependent upon the final cross-sectional shape into which it is deformed. This assumes, of course, that the force provided by the resilient block 41 corresponds to the degree to which it is compressed from the moment the article is initially contacted by the working jaws.

Figure 5:
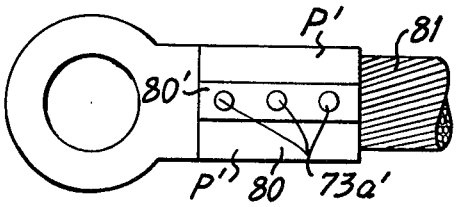
FIG. 5 is a plan view of a terminal connector having a ferrule which has been crimped by a tool according to the present invention.

FIG. 5 shows the ferrule 80 after being crimped wherein a first longitudinally extending surface section 80' is formed by the male die and a second surface section is formed by the female die (not shown in FIG. 5). Two lateral surface sections P' extend between the said first and second surface sections, the surface sections P' not being directly formed by either one of the dies. On the first surface section 80'. indentations 73*a'* are shown, the indentations being formed by the protrusions 73*a* (FIG. 1) on the male die to strengthen the mechanical connection of the ferrule 80 with the conductor 81.

When the crimping tool of the present invention is arranged as a pliers or tong-type tool, the jaw 110 (or 110') having the female die will align itself with the male die on the working jaw 120 by swinging about the pivot pin 51A upon initially contacting an article such as the ferrule 80 placed between the jaws. Thus, the working jaw 120 (or 120') having the male die may or may not also be pivotally mounted.

Figure 6A:
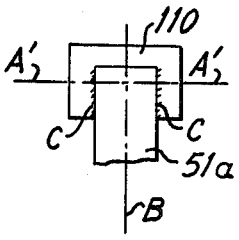
FIGS. 6A and 6B are partial side views of arm members of a modification of the tool in FIG. 1, illustrating an alternate mounting arrangement for the working jaws.
Figure 6B:
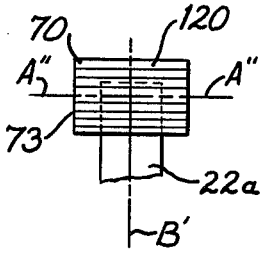

FIGS. 6A and 6B diagrammatically illustrate the rigid mounting of the working jaws. The longitudinal axes A'—A' of the female die and A''—A'' of the male die in the jaws extend at right angles to the central axes B and B' of corresponding arm members 51*a* and 22*a*, i.e., at right angles to the plane of pivotal movement of the arm members 51*a* and 22*a*, in a tong-type tool arrangement. The jaws 110, 120 are fixed to the arm members 51*a*, 22*a* by, for example, welding as shown at C in FIG. 6A. It will be understood that in a vise-type tool arrangement, rigid mounting of the working jaws is also possible with the longitudinal axis A'—A' and central axis B parallel to each other or including any other given angle.

In accordance with the embodiments disclosed herein, it will be appreciated that fully satisfactory results will be obtained with the combination and cooperation of the novel die shapes, the proper placement of the resilient block, and the pawl and ratchet locking mechanism.

While specific embodiments of the invention have been shown and described in detail to illustrate the application of the inventive principles, it will be understood that the invention may be embodied otherwise without departing from such principles.

What is claimed is:

1. A crimping tool comprising a pair of arm members mounted for relative movement with respect to each other between an open configuration and a closed configuration, drive means responsive to an externally applied driving force for moving said arm members between said open configuration and said closed configuration as said drive means is moved between corresponding open and closed configurations by the driving force, said arm members and said drive means defining a force transmission path extending between a point at which the external force is applied and a corresponding one of said arm members, a pair of working jaws each mounted on one of said arm members, an elongated female die arranged on one of said working jaws and an elongated male die arranged on the other of said working jaws, said female die having a pair of opposed side walls forming an elongated notch wherein said side walls taper toward one another from the elongated end opening of said notch to an elongated closed end wall of said notch, said male die having a base part and an elongated leading face which is spaced from said base part by a distance substantially equal to the depth of said notch, said male die having a shape which can be fully contained within said notch of said female die, locking means for preventing said drive means from returning to its open configuration after closing movement of said drive means is begun and before said drive means is moved to its closed configuration, and at least one resilient member of given hardness and strength located in said force transmission path for enabling said drive means to be moved to its closed configuration when an article to be crimped by said tool is located between said working jaws and so that said drive means can thereafter be returned to its open configuration.

2. A tool according to claim 1, wherein said notch in said female die in transverse cross-section is generally in the shape of a given parabola, the apex of the parabola being located on said closed end wall.

3. A tool according to claim 2, wherein each of said side walls of said female die forming said notch generally in the shape of the given parabola is formed by at least two straight side wall sections, the surfaces of which are substantially tangent to the parabola, each adjacent pair of side wall sections forming an obtuse angle, the side wall section of one of said side walls which is closer to said closed end wall of said notch forming a greater angle with the corresponding side wall section of the other of said side walls than corresponding side wall sections closer to the end opening of said notch, and said elongated closed end wall is formed by an elongated planar surface tangent to the apex of the given parabola.

4. A tool according to claim 1, wherein said male die is substantially complementarily shaped relative to said female die in the transverse cross-sections of said dies.

5. A tool according to claim 1, wherein said arm members are mounted for pivotal movement relative to each other and said female and male dies are mounted to extend longitudinally in the plane of pivotal movement of said arm members, at least one of said working jaws being mounted to a corresponding arm member for pivotal movement about an axis perpendicular to the plane of movement of said arm members.

6. A tool according to claim 1, including indentation means provided on at least one of said end wall of said female die and said leading face of said male die.

7. A tool according to claim 1, wherein said working jaws are rigidly joined to said arm members.

8. A tool according to claim 1 or 7, wherein said female and male dies are arranged so that their longitudinal axes extend at right angles to the plane of relative movement of the working jaws.

9. A tool for crimping elongated terminal connectors onto the ends of elongated electrical conductors, including a pair of arm members mounted for relative movement with respect to each other between an open position and a closed position, drive means responsive to an externally applied driving force for moving said arm members between said open position and said closed position as said drive means is moved between corresponding open and closed positions by the driving force, a pair of working jaws each mounted on one of said arm members, an elongated female die arranged on one of said working jaws and an elongated male die arranged on the other of said working jaws so that said dies are arranged to crimp an elongated terminal connector to an electrical conductor inserted in the connector when the connector is aligned in the long direction of said dies, said female die having a pair of opposed side walls tapering toward one another from an elongated end opening to an elongated closed smooth end wall and forming an elongated notch extending in the longitudinal direction of said female die, said notch being in transverse cross-section generally in the shape of a parabola having its apex tangent to said closed smooth end wall, said male die having a base part and an elongated smooth leading face which is spaced from said base part, said male die having a shape which can be fully contained within said notch of said female die.

10. A tool for crimping elongated terminal connectors onto the ends of elongated electrical conductors, including a pair of arm members mounted for relative movement with respect to each other between an open position and a closed position, drive means responsive to an externally applied driving force for moving said arm members between said open position and said closed position as said drive means is moved between corresponding open and closed positions by the driving force, a pair of working jaws each mounted on one of said arm members, an elongated female die arranged on one of said working jaws and an elongated male die arranged on the other of said working jaws so that said dies are arranged to crimp an elongated terminal connector to an electrical conductor inserted in the connector when the connector is aligned in the long direction of said dies, said female die having a pair of opposed side walls tapering toward one another from an elongated end opening to an elongated closed end wall and forming an elongated notch extending in the longitudinal direction of said female die, said male die having a base part and an elongated leading face which is spaced from said base part, said male die having a shape which can be fully contained within said notch of said female die, said notch being in transverse cross-section generally in the shape of a parabola having its apex tangent to said closed end wall, wherein each of said side walls of said female die forming said notch generally in the shape of a parabola is formed by at least two straight side wall sections, the surfaces of which are substantially tangent to the parabola, each adjacent pair of side wall sections forming an obtuse angle, and said elongated closed end wall is formed by an elongated planar surface tangent to the apex of the parabola.

11. A tool for crimping elongated terminal connectors onto the ends of elongated electrical conductors, including a pair of arm members mounted for relative movement with respect to each other between an open position and a closed position, drive means responsive to an externally applied driving force for moving said arm members between said open position and said closed position as said drive means is moved between corresponding open and closed positions by the driving force, a pair of working jaws each mounted on one end of said arm members, an elongated female die arranged on one of said working jaws and an elongated male die arranged on the other of said working jaws so that said dies are arranged to crimp an elongated terminal connector to an electrical conductor inserted in the connector when the connector is aligned in the long direction of said dies, said female die having a pair of opposed side walls tapering toward one another from an elongated end opening to an elongated closed smooth end wall and forming an elongated notch extending in the longitudinal direction of said female die, said male die having a base part and an elongated smooth leading face which is spaced from said base part, said male die having a shape which can be fully contained within said notch of said female die, and indentation means provided on at least one of said end wall of said female die and said leading face of said male die.

12. A tool according to claim 11, wherein said female and male dies are arranged so that their longitudinal axes extend at right angles to the plane of relative movement of the working jaws.

13. A tool according to claim 12, wherein said working jaws are rigidly joined to said arm members.

* * * * *